US011181251B1

(12) United States Patent
Chen et al.

(10) Patent No.: US 11,181,251 B1
(45) Date of Patent: Nov. 23, 2021

(54) LIGHTING APPARATUS

(71) Applicant: XIAMEN LEEDARSON LIGHTING CO., LTD, Fujian (CN)

(72) Inventors: Jinfu Chen, Fujian (CN); Zhenyu Tang, Fujian (CN); Shuxing Gao, Fujian (CN); Yongzhe Dong, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 17/074,587

(22) Filed: Oct. 19, 2020

(51) Int. Cl.

| | |
|---|---|
| ***F21V 7/04*** | (2006.01) |
| ***F21V 23/00*** | (2015.01) |
| ***F21V 3/06*** | (2018.01) |
| ***F21V 23/04*** | (2006.01) |
| ***F21Y 113/10*** | (2016.01) |
| ***F21Y 115/10*** | (2016.01) |

(52) U.S. Cl.
CPC ..... *F21V 7/04* (2013.01); *F21V 3/06* (2018.02); *F21V 23/002* (2013.01); *F21V 23/005* (2013.01); *F21V 23/04* (2013.01); *F21Y 2113/10* (2016.08); *F21Y 2115/10* (2016.08)

(58) Field of Classification Search
CPC . F21V 7/04; F21V 3/06; F21V 23/002; F21V 23/005; F21V 23/04; F21Y 2113/10; F21Y 2115/10
See application file for complete search history.

(56) References Cited

U.S. PATENT DOCUMENTS

2010/0046223 A1* 2/2010 Li ..... F21V 17/12 362/249.02
2012/0293057 A1* 11/2012 Yamamoto ..... F21K 9/232 313/45

FOREIGN PATENT DOCUMENTS

CN 101268561 A * 9/2008 ..... F21K 9/00
CN 101929623 A * 12/2010 ..... F21S 8/06
CN 102844612 A * 12/2012 ..... H05B 45/00
CN 103574356 A * 2/2014 ..... F21V 29/677
CN 108885351 A * 11/2018 ..... A61L 2/10
WO WO-2004107457 A2 * 12/2004 ..... F21V 5/04

* cited by examiner

*Primary Examiner* — Mary Ellen Bowman
(74) *Attorney, Agent, or Firm* — Chun-Ming Shih; Lanway IPR Services

(57) ABSTRACT

A lighting apparatus includes a light source plate, a light passing cover and a surface rim. The light source plate is mounted with LED modules and a driver circuit. The light passing cover has a circular curved surface. The circular curved surface has a first diameter. A curvature of the circular curved surface is a first radius of a corresponding osculating circle. A ratio between the first diameter to the first radius multiplied with two is between 0.25 to 0.75. The surface rim has a central concave platform for disposing the light source plate. The driver circuit converts an external power source to a driving current supplied to the LED modules to emit a light passing through the light passing cover.

19 Claims, 8 Drawing Sheets

LIGHTING APPARATUS

FIELD

The present invention is related to a lighting apparatus, and more particularly related to a lighting apparatus with nice light patterns.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People install various light devices to different environments. Some light devices are selected for functions and some are selected for low cost.

It is beneficial to design a lighting device with flexibility and easy to use while keeping a low cost. People install various light devices to different environments. Some light devices are selected for functions and some are selected for low cost.

SUMMARY

In some embodiments, a lighting apparatus includes a light source plate, a light passing cover and a surface rim.

The light source plate is mounted with LED modules and a driver circuit.

The light passing cover has a circular curved surface.

The circular curved surface has a first diameter.

A curvature of the circular curved surface is a first radius of a corresponding osculating circle.

A ratio between the first diameter to the first radius multiplied with two is between 0.25 to 0.75.

The surface rim having a central concave platform for disposing the light source plate.

The driver circuit converts an external power source to a driving current supplied to the LED modules to emit a light passing through the light passing cover.

The driver circuit may have multiple circuit components, e.g. capacitors, resistors, integrated chips.

To define a curvature of a curve surface, an osculating circle is found to match the edge side of the curve surface. The radius length is then used for describing the curvature of the curved surface.

The ratio between 0.25 to 0.75 is found helpful for generating a great illumination of projected light pattern.

It would even be better if the ratio is set between 0.5 to 0.6.

In some embodiments, the ratio between the first diameter multiplied with two to the first radius is between 0.5 to 0.6.

In some embodiments, the light passing cover is a made of a plastic material doped with micro particles for diffusing the light of the LED modules passing through the light passing cover.

In some embodiments, the central part has higher density of micro dots than peripheral areas of the light passing cover.

The micro dots may be doped into the plastic material like PS, PC, PMMA while molding the light passing cover. The micro dots guide light hit thereon to reflect to random directions to achieve the diffusion effect.

In some embodiments, the lighting apparatus may also include a transparent layer covering the LED modules and the driver circuit.

The transparent layer provides an electricity insulation layer.

In some embodiments, the light passing cover is detachable during installation of the lighting apparatus to an installation platform, e.g. a cavity, a junction box or a bracket previously fixed to an installation surface.

When the light passing cover is detached from the surface rim, it is danger for users because the LED modules and the driver circuit may cause electric shocks.

Such transparent layer may be a plastic layer. In some embodiments, the transparent layer may be a harden gel that prevents human touch the driver circuit and the LED modules.

The transparent layer is electricity insulated.

In some embodiments, the electricity insulation layer has an escape area for manually fixing the surface rim to an installation platform before placing back the light passing cover to the surface rim.

As mentioned above, in some embodiments, the light passing cover is detachable from the surface rim for fixing the surface rim to an installation platform.

Specifically, the escape area reserved to be exposed by the transparent layer may have screw holes to add screws to fix the surface rim to the installation platform.

In some embodiments, the light source plate may reserve and expose the fixing structure of the surface rim. In some embodiments, the fixing structure is a screw holes passing through both the light source plate and the central concave platform.

After the surface rim is fixed to the installation plate, the light passing cover is attached to the surface rim to complete the installation.

In addition to structural connection, there is also an electrical connection. To achieve the electrical connection, a plugging structure may be used for connecting the driver circuit to an external power wire. Other ways for connecting the driver circuit to an external power line for the driver circuit to convert the external power like 110V/220V alternating current may also be used on different requirements.

In some embodiments, the transparent layer has multiple lens respectively facing to the LED modules.

In addition to protect users from electrical shock, the transparent layer may also have multiple lens structure integrated with the transparent layer to change light directions of the LED modules, e.g. to generate light beams or diffused lights.

In some embodiments, the transparent layer has a reflective layer for guiding the light of the LED modules away from the driver circuit.

In addition to the LED modules, the driver circuit having multiple circuit components may affect the light of the LED modules, e.g. causing shadow.

In addition, such components may be damaged under light emission for long time.

Therefore, the transparent layer may have certain areas with reflective areas for reflecting lights away from the driver circuit.

Such reflective areas may be produced by attaching a panting layer, a reflective film or other units for creating reflection effect.

In some embodiments, the central concave platform has a wire opening for inserting a wire to be connected to the driver circuit on the light source plate.

As mentioned above, the central concave platform may have a wire opening for inserting an external power wire connected to an external power source.

Sockets, plugging structures, fixing cap or other ways may be used for connecting the power wire to the driver circuit.

In some embodiments, a first set of the LED modules are arranged at a peripheral circular area.

Some LED modules are arranged as a circle on a peripheral area of the light source plate.

In some embodiments, a second set of the LED modules are surrounded by the first set of the LED modules.

The first set of the LED modules and the second set of the LED modules emit lights of different color temperatures.

Some other LED modules, with the same or different types as the LED modules in the peripheral area, may be disposed surrounded by the LED modules at the peripheral area.

They may emit lights of different color temperatures or colors that are mixed together to get a required color temperature or a required color.

In some embodiments, the driver circuit is surrounded by the first set of the LED modules.

In some embodiments, the circuit components of the driver circuit are located at center place keeping a distance from the LED modules.

In some embodiments, the driver circuit has an exterior surface attached with a reflective layer.

To decrease influence of the driver circuit to the overall light output effect and to protect the driver circuit, an exterior surface of the driver circuit may be added with a reflective layer, e.g. coated or painted with a light color like white color.

In some embodiments, the reflective layer is made by a light color painting.

In some embodiments, the surface rim has a surrounding ring enclosing the central concave platform.

A rim curvature of the surface rim is within 20% difference to the curvature of the light passing cover.

Specifically, the curvature of the surface rim is similar to the curvature of the light passing cover, e.g. with a difference less than 20%.

In some embodiments, the central concave platform has a pair of fixing structures for attaching fixing structures to fix the surface rim to an installation platform.

In some embodiments, each fixing structure has a key hole.

Each key hole has an entrance hole with a larger diameter than a sliding track.

In some embodiments, the surface rim has a detachable bracket.

The detachable bracket is fixed to the installation platform first before attaching the surface rim to the detachable bracket.

In some embodiments, the LED modules have multiple types.

Different types emit lights of different color temperatures.

In some embodiments, the lighting apparatus may also include a manual switch for controlling the driver circuit to control the LED modules to mix a required color temperature.

Such manual switch may be a dip switch, a button, a sliding switch, a touch panel or even a wireless receiver for receiving an external command from an external device.

In some embodiments, the surface rim is made of metal material and there is an antenna area for disposing an antenna electrically connected to the driver circuit.

When the driver circuit is placed in the central concave platform, a wireless module may be affected by the surrounding wall of the surface rim, particularly when the surrounding wall is made of metal material.

In some embodiments, an antenna is disposed on an exterior surface not shielded by other components. The antenna is electrically connected to the driver circuit to enhance wireless signal quality.

DETAILED DESCRIPTION

Figure 1:
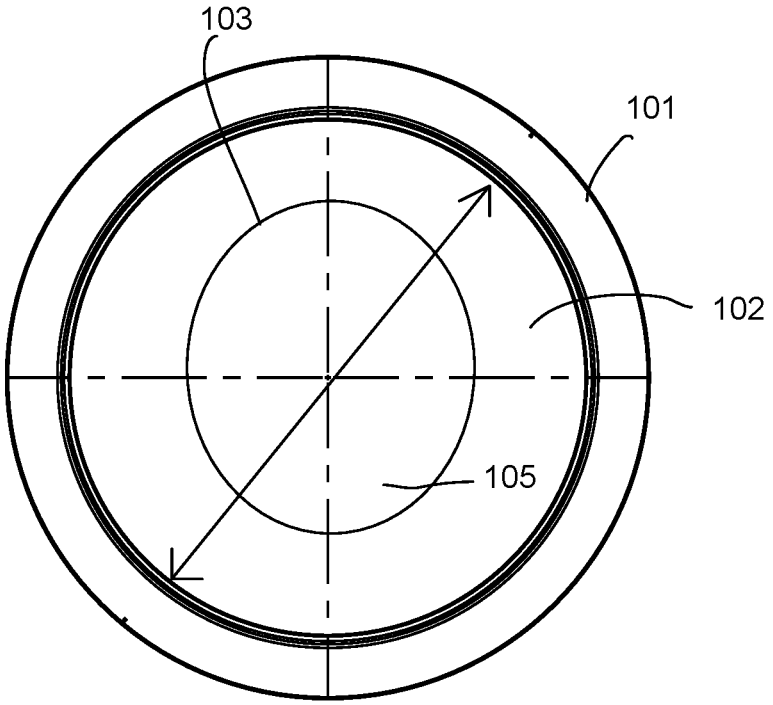
FIG. 1 shows a lighting apparatus embodiment.
Figure 2:
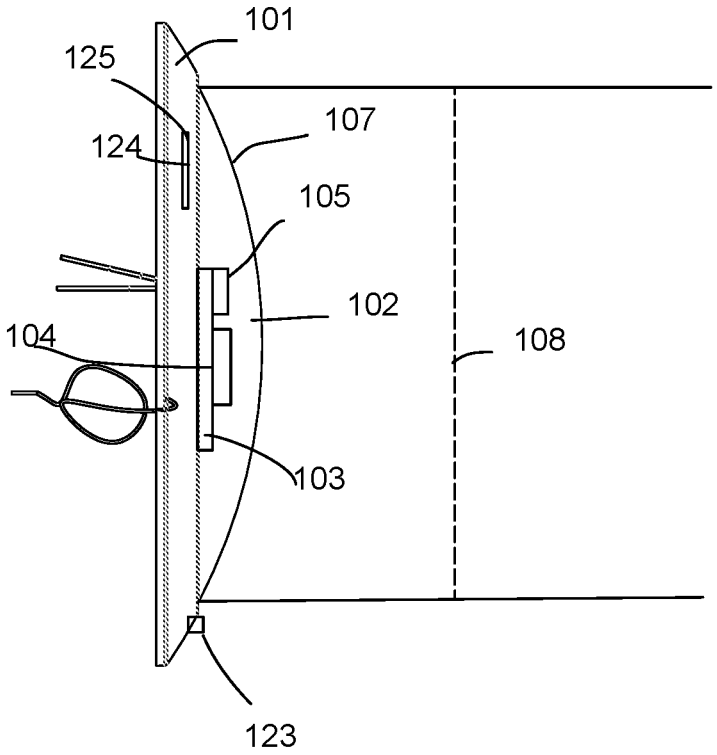
FIG. 2 shows another view of the example in FIG. 1.

Please refer to FIG. 1 and FIG. 2, which illustrate a bottom view and a side view of a lighting apparatus embodiment. The lighting apparatus includes a light source plate 103, a light passing cover 102 and a surface rim 101.

The light source plate 103 is mounted with LED modules 105 and a driver circuit 104.

The light passing cover 102 has a circular curved surface 107.

The circular curved surface 107 has a first diameter 108.

A curvature of the circular curved surface 107 is a first radius of a corresponding osculating circle.

To measure a curvature of a curved surface, an associated osculating circle is found with a portion of circular edge matching the curved surface. The radius of the associated osculating circuit is used for defining the curvature of the curved surface. In some embodiments, the curved surface may have several segments mapping to several osculating circles. In such case, the main osculating circle that maps main portion, e.g. more than 70%, of the curved surface is used for representing the curvature of the curved surface.

Figure 3:
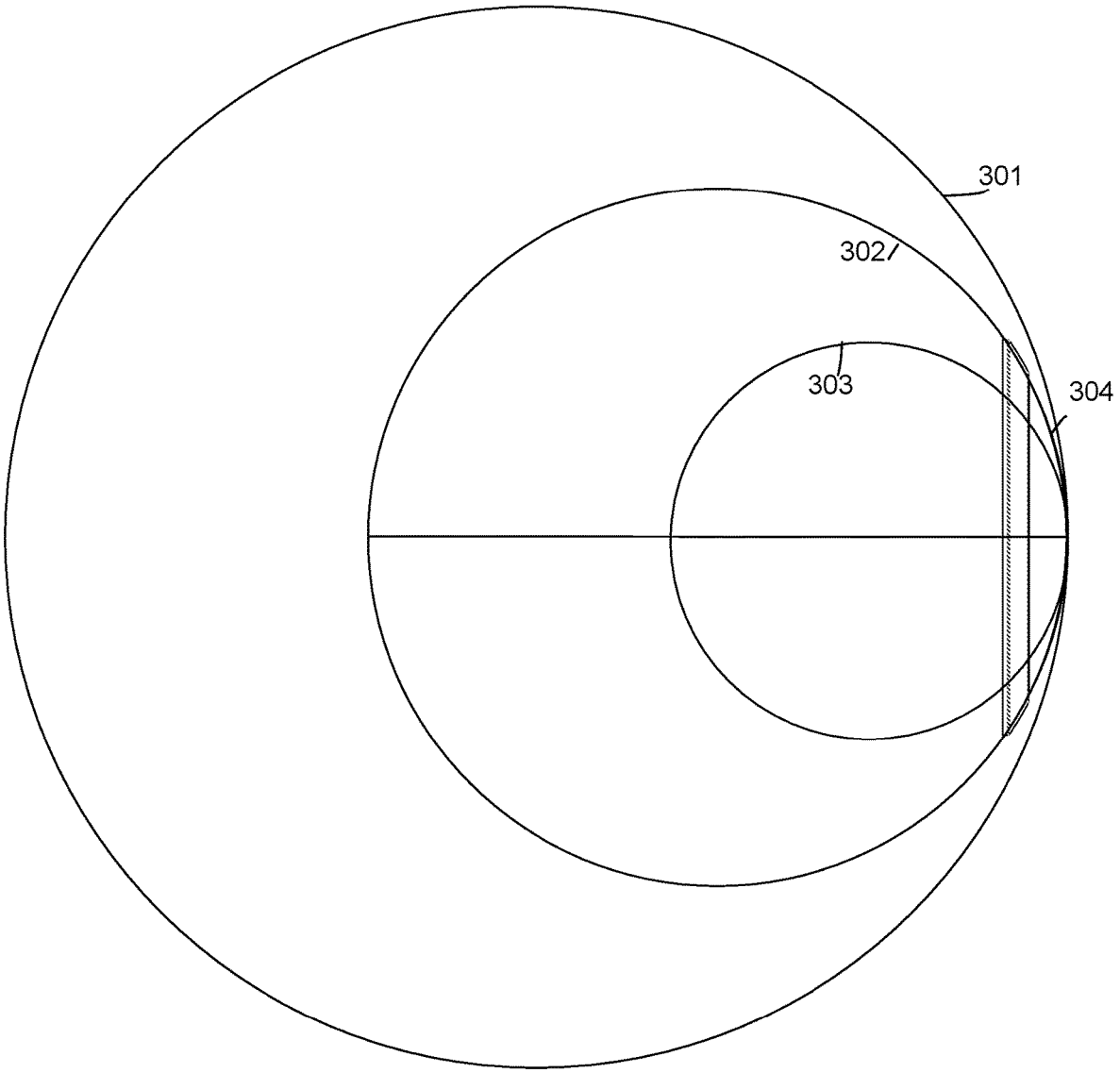
FIG. 3 shows a relation between an osculation circle and a curved surface.

FIG. 3 shows a lighting apparatus 304 example with a curved surface as illustrated in FIG. 1 and FIG. 2. In FIG. 3, there are three osculating circles 301, 302, 303, with different radiuses. The osculating circle 301 has the largest radius while the osculating circle 303 has the smallest radius. It is clear to see that when the curved surface is mapped to an osculating circle with a larger radius, its curvature is smoother.

It is found that a ratio between the first diameter to the first radius multiplied with two is between 0.25 to 0.75. Specifically, a first value is the first diameter of the curved surface and a second value is the radius of an osculating circle associated with the curved surface. The second value is multiplied with two to obtain a third value. The ratio is obtained by dividing the first value with the third value. FIG. 3 illustrated a ratio range of the curved surface between two osculating circles 301 and 303.

Figure 4:
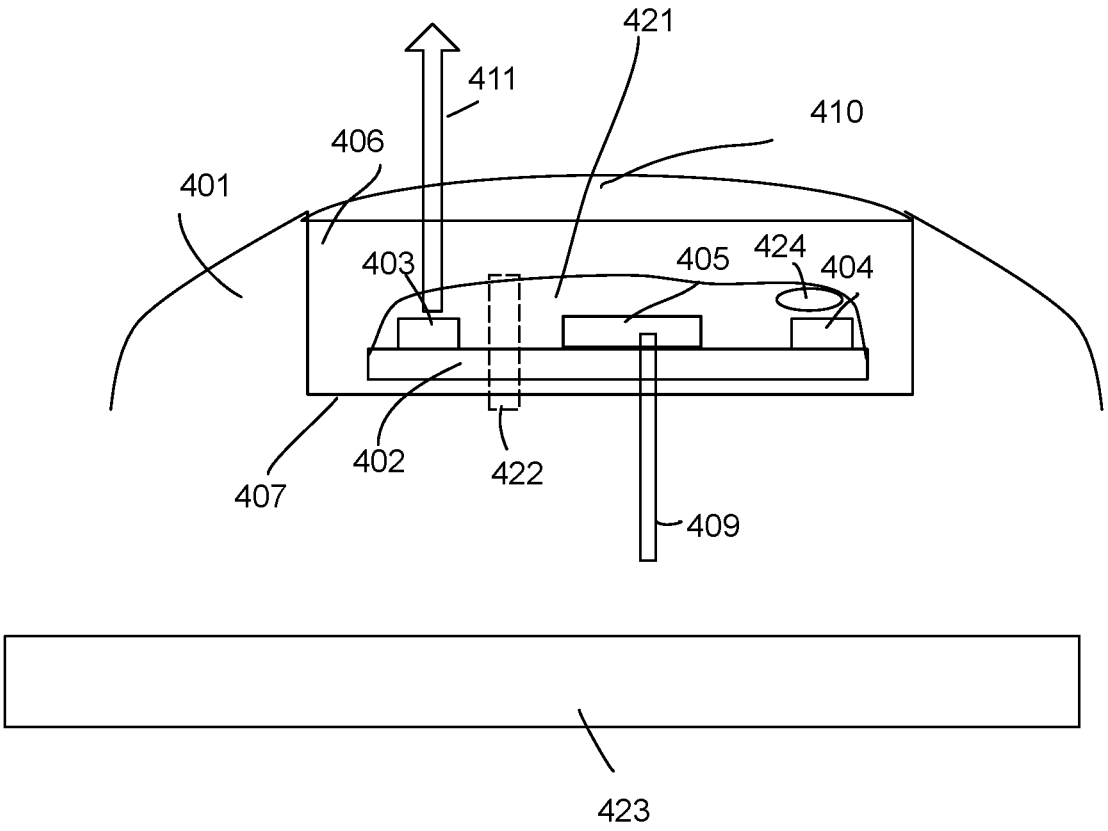
FIG. 4 shows relations among components.

Please see FIG. 4, which shows an example of a surface rim 401. The surface rim 401 has a central concave platform 407 for disposing the light source plate 402.

The driver circuit 405 converts an external power source 409 to a driving current supplied to the LED modules 403 to emit a light 411 passing through the light passing cover 410.

The driver circuit 405 may have multiple circuit components, e.g. capacitors, resistors, integrated chips.

To define a curvature of a curve surface, an osculating circle is found to match the edge side of the curve surface. The radius length is then used for describing the curvature of the curved surface.

The ratio between 0.25 to 0.75 is found helpful for generating a great illumination of projected light pattern.

It would even be better if the ratio is set between 0.5 to 0.6.

In some embodiments, the ratio between the first diameter multiplied with two to the first radius is between 0.5 to 0.6.

Figure 5:
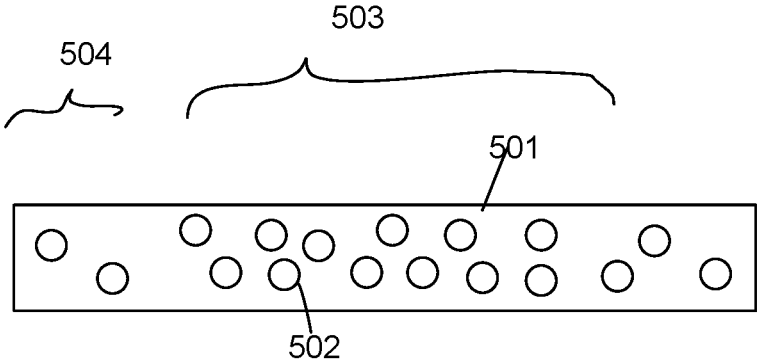
FIG. 5 shows an example of a light passing cover.

Please see FIG. 5. In some embodiments, the light passing cover is a made of a plastic material doped with micro particles 502, e.g. with diameter less than 0.5 mm, for diffusing the light of the LED modules passing through the light passing cover.

In some embodiments, the central part 503 has higher density of micro dots than peripheral areas 504 of the light passing cover 501. The micro dots may be doped into the plastic material like PS, PC, PMMA while molding the light passing cover. The micro dots guide light hit thereon to reflect to random directions to achieve the diffusion effect.

In FIG. 4, the lighting apparatus may also include a transparent layer 421 covering the LED modules and the driver circuit.

The transparent layer provides an electricity insulation layer.

In some embodiments, the light passing cover is detachable during installation of the lighting apparatus to an installation platform, e.g. a cavity, a junction box or a bracket previously fixed to an installation surface.

When the light passing cover is detached from the surface rim, it is danger for users because the LED modules and the driver circuit may cause electric shocks.

Such transparent layer may be a plastic layer. In some embodiments, the transparent layer may be a harden gel that prevents human touch the driver circuit and the LED modules.

The transparent layer is electricity insulated.

In FIG. 4, the electricity insulation layer 421 has an escape area 422 for manually fixing the surface rim to an installation platform 423 before placing back the light passing cover 410 to the surface rim 401.

As mentioned above, in some embodiments, the light passing cover is detachable from the surface rim for fixing the surface rim to an installation platform.

Specifically, the escape area reserved to be exposed by the transparent layer may have screw holes to add screws to fix the surface rim to the installation platform.

In some embodiments, the light source plate may reserve and expose the fixing structure of the surface rim. In some embodiments, the fixing structure is a screw hole passing through both the light source plate and the central concave platform.

After the surface rim is fixed to the installation plate, the light passing cover is attached to the surface rim to complete the installation.

In addition to structural connection, there is also an electrical connection. To achieve the electrical connection, a plugging structure may be used for connecting the driver circuit to an external power wire. Other ways for connecting the driver circuit to an external power line for the driver circuit to convert the external power like 110V/220V alternating current may also be used on different requirements.

In some embodiments, the transparent layer has multiple lens 424 respectively facing to the LED modules 404.

In addition to protect users from electrical shock, the transparent layer may also have multiple lens structure integrated with the transparent layer to change light directions of the LED modules, e.g. to generate light beams or diffused lights.

Figure 6:
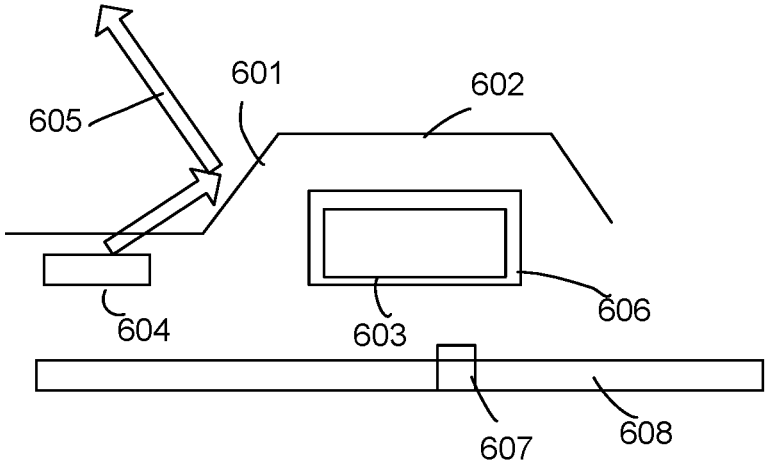
FIG. 6 shows a reflective layer attached to a transparent layer.

In FIG. 6, the transparent layer 602 has a reflective layer 601 for guiding the light 605 of the LED modules 604 away from the driver circuit 603.

In addition to the LED modules, the driver circuit having multiple circuit components may affect the light of the LED modules, e.g. causing shadow.

In addition, such components may be damaged under light emission for long time.

Therefore, the transparent layer may have certain areas with reflective areas for reflecting lights away from the driver circuit.

Such reflective areas may be produced by attaching a panting layer, a reflective film or other units for creating reflection effect.

In FIG. 6, the driver circuits 603 like integrated chips may have a reflective layer 606 on their surfaces, e.g. a white surface, with a coated reflective layer, or with other material layer suitable for reflecting lights thereon.

In FIG. 6, the central concave platform 608 has a wire opening 607 for inserting a wire to be connected to the driver circuit on the light source plate.

As mentioned above, the central concave platform may have a wire opening for inserting an external power wire connected to an external power source.

Sockets, plugging structures, fixing cap or other ways may be used for connecting the power wire to the driver circuit.

Figure 7:
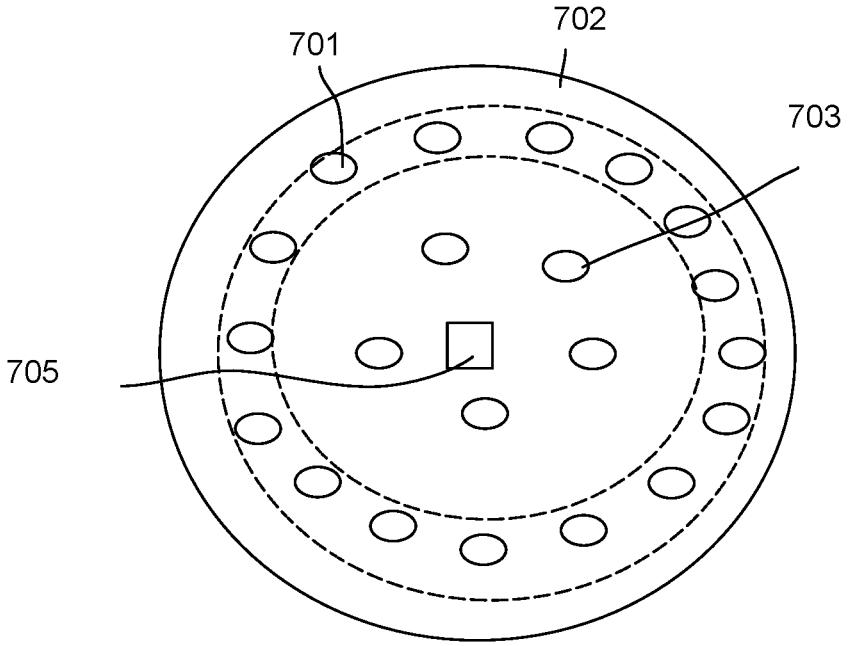
FIG. 7 shows an arrangement pattern of LED modules on a light source plate.

In FIG. 7, a first set 701 of the LED modules are arranged at a peripheral circular area of a light source plate 702.

Some LED modules are arranged as a circle on a peripheral area of the light source plate.

In some embodiments, a second set 703 of the LED modules are surrounded by the first set 701 of the LED modules.

The first set 701 of the LED modules and the second set 703 of the LED modules emit lights of different color temperatures.

Some other LED modules, with the same or different types as the LED modules in the peripheral area, may be disposed surrounded by the LED modules at the peripheral area.

They may emit lights of different color temperatures or colors that are mixed together to get a required color temperature or a required color.

In FIG. 7, the driver circuit 705 is surrounded by the first set 701 of the LED modules.

In some embodiments, the circuit components of the driver circuit are located at center place keeping a distance from the LED modules.

In some embodiments, the driver circuit has an exterior surface attached with a reflective layer, as shown in the example of FIG. 6.

To decrease influence of the driver circuit to the overall light output effect and to protect the driver circuit, an exterior surface of the driver circuit may be added with a reflective layer, e.g. coated or painted with a light color like white color.

In some embodiments, the reflective layer is made by a light color painting.

In some embodiments, the surface rim has a surrounding ring enclosing the central concave platform.

A rim curvature of the surface rim is within 20% difference to the curvature of the light passing cover.

Specifically, the curvature of the surface rim is similar to the curvature of the light passing cover, e.g. with a difference less than 20%.

Figure 8:
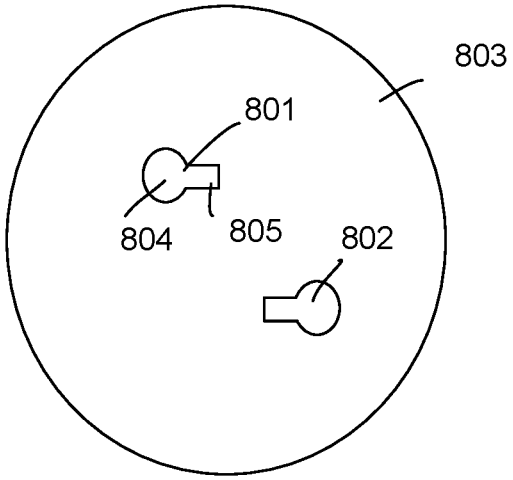
FIG. 8 shows a surface rim structure.

In FIG. 8*t*, the central concave platform 803 has a pair of fixing structures 801, 802 for attaching fixing structures to fix the surface rim to an installation platform.

In some embodiments, each fixing structure has a key hole.

Each key hole has an entrance hole 804 with a larger diameter than a sliding track 805.

In some embodiments, the surface rim has a detachable bracket.

The detachable bracket is fixed to the installation platform first before attaching the surface rim to the detachable bracket.

In some embodiments, the LED modules have multiple types.

Different types emit lights of different color temperatures.

In FIG. 2, the lighting apparatus may also include a manual switch 123 for controlling the driver circuit to control the LED modules to mix a required color temperature.

Such manual switch may be a dip switch, a button, a sliding switch, a touch panel or even a wireless receiver for receiving an external command from an external device.

In some embodiments, the surface rim is made of metal material and there is an antenna area 125 for disposing an antenna electrically connected to the driver circuit.

When the driver circuit is placed in the central concave platform, a wireless module 124 may be affected by the surrounding wall of the surface rim 101, particularly when the surrounding wall is made of metal material.

In some embodiments, an antenna is disposed on an exterior surface not shielded by other components. The antenna is electrically connected to the driver circuit to enhance wireless signal quality.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source plate mounted with LED modules and a driver circuit;

a light passing cover having a circular curved surface, wherein the circular curved surface has a first diameter, a curvature of the circular curved surface is a first radius of a corresponding osculating circle, a ratio between the first diameter to the first radius times two is between 0.25 to 0.75; and a transparent layer covering the LED modules and the driver circuit on the same side of the light source plate, wherein the transparent layer provides an electricity insulation layer;

a surface rim having a central concave platform for disposing the light source plate, the driver circuit converts an external power source to a driving current supplied to the LED modules to emit a light passing through the light passing cover.

2. The lighting apparatus of claim 1, wherein the ratio between the first diameter to the first radius times two is between 0.5 to 0.6.

3. The lighting apparatus of claim 1, wherein the light passing cover is a made of a plastic material doped with micro particles for diffusing the light of the LED modules passing through the light passing cover.

4. The lighting apparatus of claim 1, wherein the electricity insulation layer has an escape area for manually fixing the surface rim to an installation platform before placing back the light passing cover to the surface rim.

5. The lighting apparatus of claim 1, wherein the transparent layer has multiple lens respectively facing to the LED modules.

6. The lighting apparatus of claim 1, wherein the transparent layer has a reflective layer for guiding the light of the LED modules away from the driver circuit.

7. The lighting apparatus of claim 1, wherein the central concave platform has a wire opening for inserting a wire to be connected to the driver circuit on the light source plate.

8. The lighting apparatus of claim 1, wherein a first set of the LED modules are arranged at a peripheral circular area.

9. The lighting apparatus of claim 8, wherein a second set of the LED modules are surrounded by the first set of the LED modules, the first set of the LED modules and the second set of the LED modules emit lights of different color temperatures.

10. The lighting apparatus of claim 8, wherein the driver circuit is surrounded by the first set of the LED modules.

11. The lighting apparatus of claim 1, wherein the driver circuit has an exterior surface attached with a reflective layer.

12. The lighting apparatus of claim 11, wherein the reflective layer is made by a light color painting.

13. The lighting apparatus of claim 1, wherein the surface rim has a surrounding ring enclosing the central concave platform, a rim curvature of the surface rim is within 20% difference to the curvature of the light passing cover.

14. The lighting apparatus of claim 1, wherein the central concave platform has a pair of fixing structures for attaching fixing structures to fix the surface rim to an installation platform.

15. The lighting apparatus of claim 14, wherein each fixing structure has a key hole, each key hole has an entrance hole with a larger diameter than a sliding track.

16. The lighting apparatus of claim 14, wherein the surface rim has a detachable bracket, the detachable bracket is fixed to the installation platform first before attaching the surface rim to the detachable bracket.

17. The lighting apparatus of claim 1, wherein the LED modules have multiple types, different types emit lights of different color temperatures.

18. The lighting apparatus of claim 17, further comprising a manual switch for controlling the driver circuit to control the LED modules to mix a required color temperature.

19. The lighting apparatus of claim 1, wherein the surface rim is made of metal material and there is an antenna area for disposing an antenna electrically connected to the driver circuit.

* * * * *